US007857534B2

(12) United States Patent
Watanabe et al.

(10) Patent No.: US 7,857,534 B2
(45) Date of Patent: Dec. 28, 2010

(54) PRINTER APPARATUS

(75) Inventors: Sumio Watanabe, Shinagawa (JP); Fumio Sakurai, Shinagawa (JP); Yukihiro Mori, Shinagawa (JP); Masahiro Tsuchiya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 723 days.

(21) Appl. No.: 11/475,941

(22) Filed: Jun. 28, 2006

(65) Prior Publication Data

US 2007/0104527 A1 May 10, 2007

(30) Foreign Application Priority Data

Nov. 9, 2005 (JP) ..... 2005-325121

(51) Int. Cl.
*B41J 11/66* (2006.01)

(52) U.S. Cl. ..... 400/621; 400/691; 400/693; 346/24; 347/222

(58) Field of Classification Search ..... None
See application file for complete search history.

(56) References Cited

U.S. PATENT DOCUMENTS

| | | | | |
|---|---|---|---|---|
| 4,340,315 | A | 7/1982 | Teichmann et al. | |
| 4,663,638 | A | 5/1987 | Hirose | |
| 4,744,680 | A * | 5/1988 | Hirosaki et al. | 400/692 |
| 5,672,020 | A * | 9/1997 | Leonard et al. | 400/692 |
| 6,234,696 | B1 * | 5/2001 | Whittaker | 400/613 |
| 6,261,013 | B1 * | 7/2001 | Bryer et al. | 400/613 |
| 6,508,600 | B1 * | 1/2003 | Nonaka | 400/621 |
| 2003/0156883 | A1 | 8/2003 | Kobayashi et al. | |
| 2005/0207813 | A1 * | 9/2005 | Takabatake et al. | 400/611 |
| 2005/0232678 | A1 | 10/2005 | Mochizuki et al. | |

FOREIGN PATENT DOCUMENTS

| | | |
|---|---|---|
| DE | 30 09 001 | 9/1981 |
| DE | 35 22 022 | 1/1986 |
| EP | 1 559 563 | 8/2005 |

OTHER PUBLICATIONS

"Customer Replaceable Cash Receipt Cutter", IBM Technical Disclosure Bulletin, IBM Corp., vol. 32, No. 3B, Aug. 1, 1989, pp. 421-422.

Extended European Search Report, mailed Sep. 5, 2008 and issued in corresponding European Patent Application No. 06253312.0-2304.

* cited by examiner

*Primary Examiner*—Jill E Culler
(74) *Attorney, Agent, or Firm*—Staas & Halsey LLP

(57) ABSTRACT

A printer apparatus is disclosed that includes a main body having a paper roll installing part containing a paper roll therein; a cover covering the paper roll installing part when the cover is closed; a printing part for printing data onto a part of the paper roll; and a presenter unit part mounted on the cover. The presenter unit part is configured to accommodate the printed portion of the paper roll, cut off the printed portion from the paper roll, and discharge the cut-off printed portion therefrom.

19 Claims, 10 Drawing Sheets

PRINTER APPARATUS

BACKGROUND OF THE INVENTION

1. Field of the Invention

The present invention generally relates to a printer apparatus, and more particularly to a printer apparatus having a presenter function which is a function of discharging a cut-off printed sheet of paper from the printer apparatus.

2. Description of the Related Art

In general, a conventional cash register includes a printer apparatus for printing out a receipt. For reducing the burden of the operator of the cash register, such printer apparatus is desired to be equipped with a presenter function which cuts off a printed receipt and discharges the receipt from the printer apparatus. Furthermore, the printer apparatus having the presenter function is desired to have a small size since the size of the cash register is limited.

The conventional printer apparatus providing the presenter function has a configuration in which a presenter unit having the presenter function is mounted thereon.

This configuration increases the size of the printer apparatus and is unsuitable for assembling the printer apparatus inside the cash register.

SUMMARY OF THE INVENTION

The present invention may provide a printer apparatus that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by printer apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the invention provides a printer apparatus including: a main body having a paper roll installing part containing a paper roll therein; a cover covering the paper roll installing part when the cover is closed; a printing part for printing data onto a part of the paper roll; and a presenter unit part mounted on the cover; wherein the presenter unit part is configured to accommodate the printed portion of the paper roll, cut off the printed portion from the paper roll, and discharge the cut-off printed portion therefrom.

Furthermore, another embodiment of the present invention provides a printer apparatus including: a main body having a paper roll installing part containing a paper roll therein; a cover covering the paper roll installing part when the cover is closed; a printing part for printing data onto a part of the paper roll; a cutting part for cutting off the printed portion from the paper roll; and a presenter unit part mounted on the cover; wherein the presenter unit part is configured to accommodate the cut-off printed portion of the paper roll and discharge the cut-off printed portion therefrom.

Other objects and further features of the present invention will be apparent from the following detailed description when read in conjunction with the accompanying drawings.

BRIEF DESCRIPTION OF THE DRAWINGS

FIG. 9 is a schematic drawing showing the printer apparatus according to the second embodiment of the present invention in a case where the printer apparatus is mounted on a panel or the like;

DESCRIPTION OF THE PREFERRED EMBODIMENTS

In the following, embodiments of the present invention are described with reference to the accompanying drawings.

First Embodiment

Figure 1:
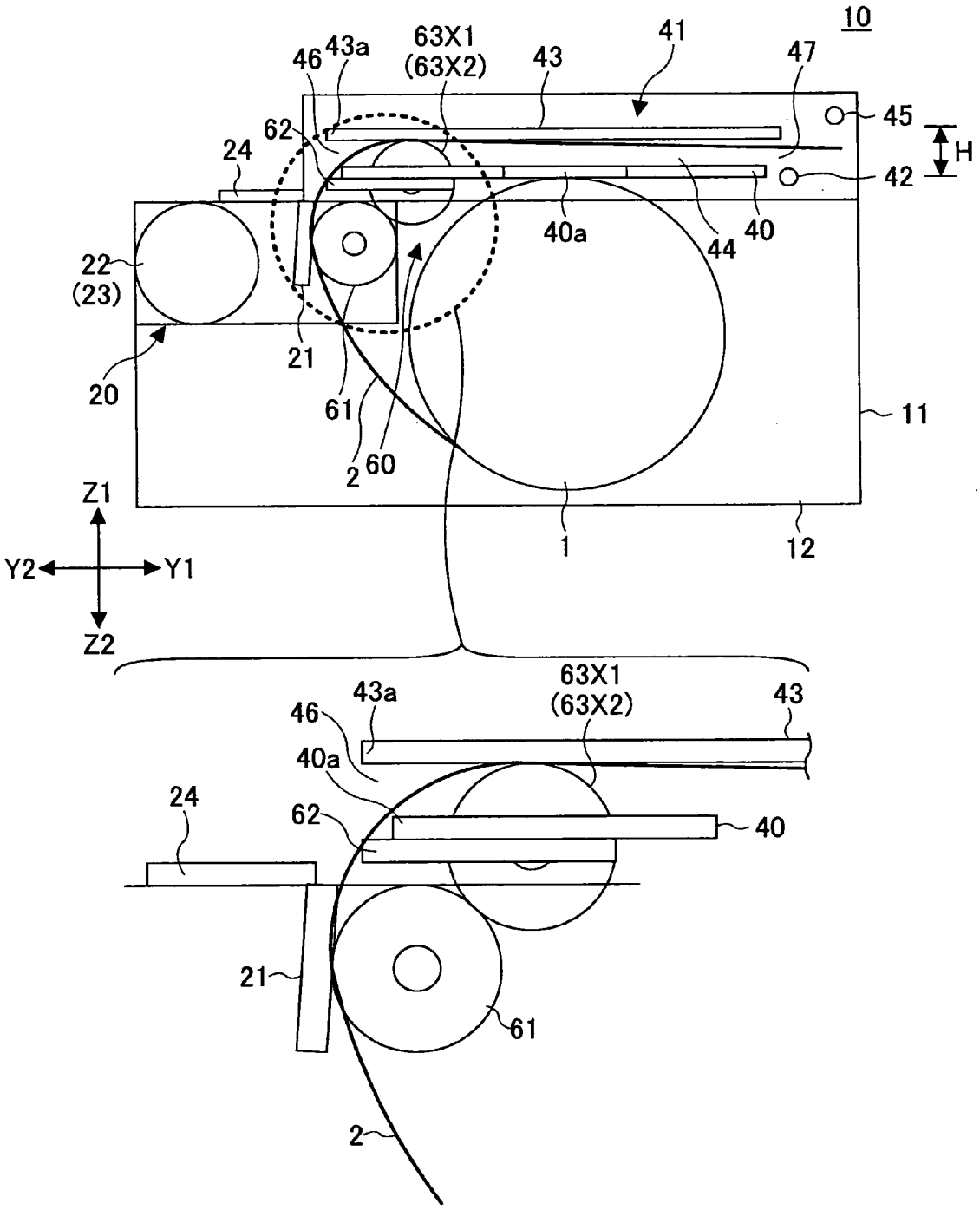
FIG. 1 is a schematic drawing showing a printer apparatus having a presenter function according to a first embodiment of the present invention.
Figure 3:
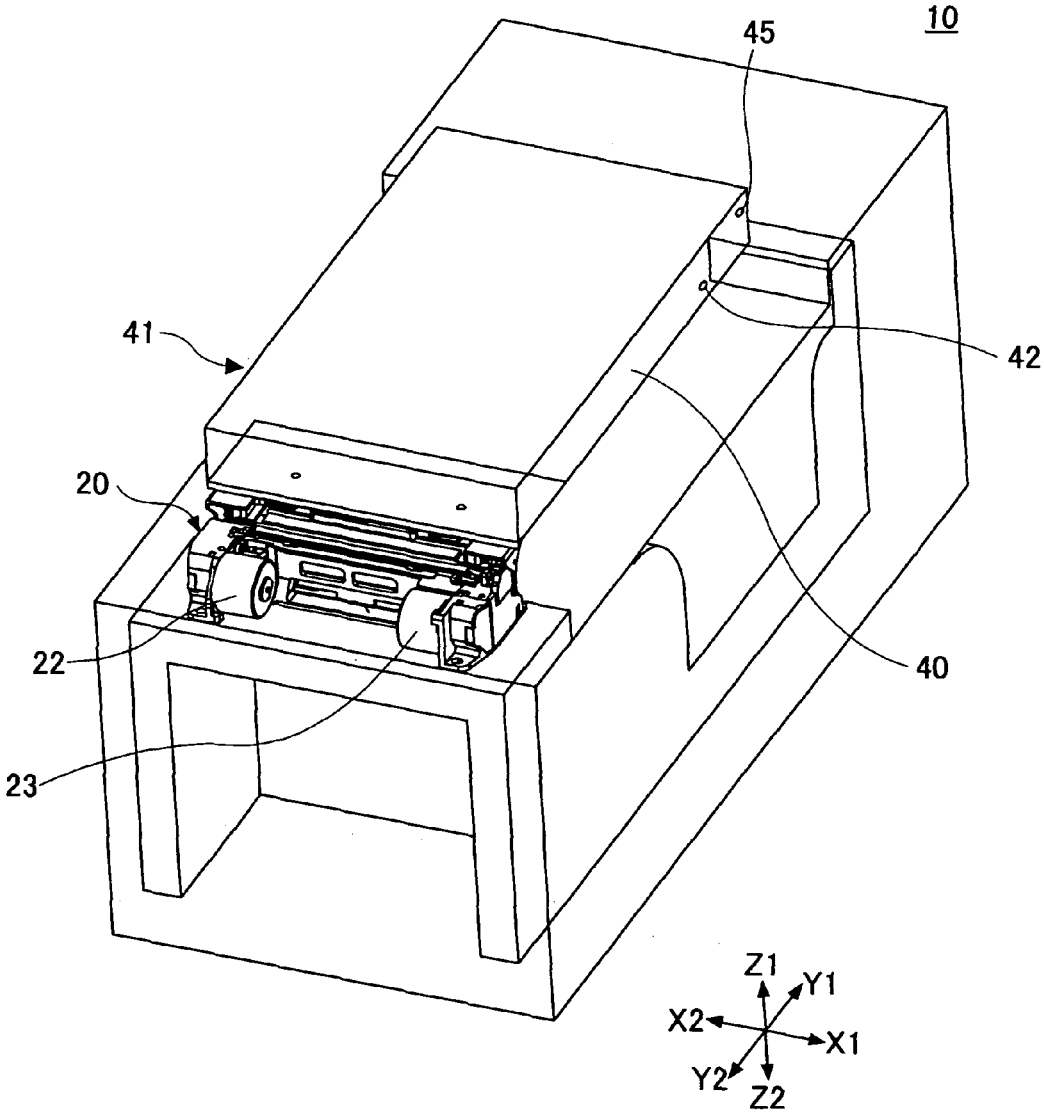
FIG. 3 is a perspective view of the printer apparatus according to the first embodiment of the present invention.
Figure 4:
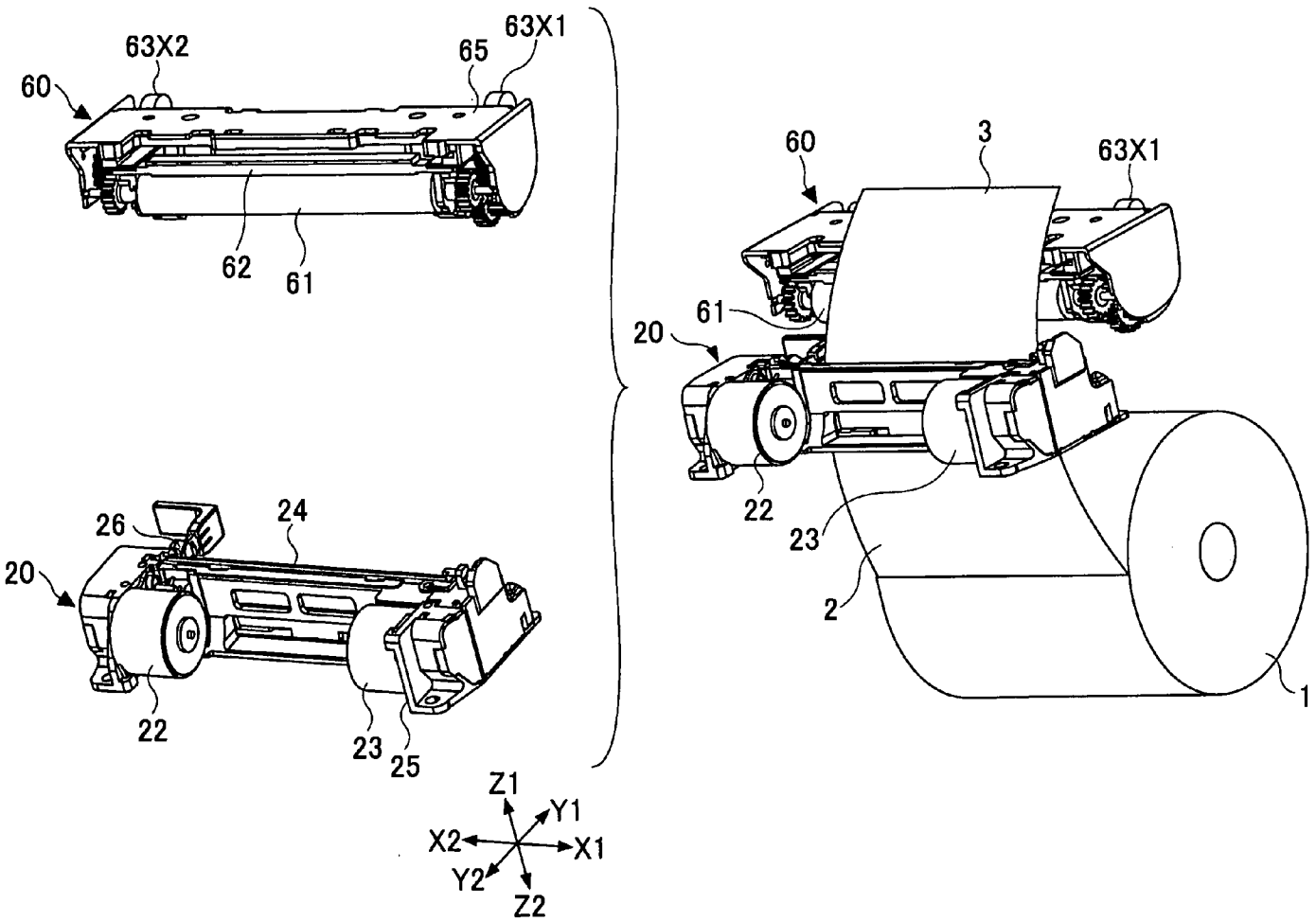
FIG. 4 is a schematic drawing for describing a main module of the printer apparatus in correspondence with a submodule of the printer apparatus according to an embodiment of the present invention.

FIG. 1 is a schematic drawing showing a printer apparatus 10 (in this example, a thermal printer) having a presenter function according to the first embodiment of the present invention. FIGS. 2A-2D are schematic drawings for describing an operation of the printer apparatus 10 shown in FIG. 1. FIG. 3 is a perspective view of the printer apparatus 10 according to the first embodiment of the present invention. FIG. 4 is a schematic drawing for describing a main module 20 of the printer apparatus 10 in correspondence with a submodule 60 of the printer apparatus 10 according to the first embodiment of the present invention. In the drawings, directions X1-X2 indicate the width direction of the printer apparatus 10, directions Y1-Y2 indicate the longitudinal directions of the printer apparatus 10, and directions Z1-Z2 indicate the height direction of the printer apparatus 10.

As shown in FIGS. 1 and 3, the printer apparatus 10 is a clamshell type thermal printer. The printer apparatus 10 includes the presenter unit part 41 provided at an upper part of a cover 40 for covering a thermal paper roll installing part (sub-module metal fitting) 12. The presenter unit part 41, being substantially low in height H, is simply placed on top of the cover 40 for enabling size-reduction of the printer apparatus 10 having the presenter function.

As shown in FIGS. 1 and 3, the printer apparatus 10 includes an apparatus frame 11, a main module 20, the cover 40 having a presenter unit part 41 attached thereto, and a sub-module 60.

As FIGS. 1 and 3, the apparatus frame 11 includes the thermal paper roll installing part 12 that accommodates a thermal paper roll 1.

As shown in FIGS. 1, 3, and 4, the main module 20 has a main module frame 25 to which components, for example, a thermal head 21, a cutter stepping motor 23 used for driving a movable blade 62 (described below), a fixed blade 24, and a locking member 26 are attached. The main module 20 is attached to the apparatus frame 11.

As shown in FIGS. 1 and 3, the cover 40 is attached to an outer-cover 43 via a shaft 42. Accordingly, the cover 40 covers the thermal paper roll installing part 12 when in a closed state.

Figure 6:
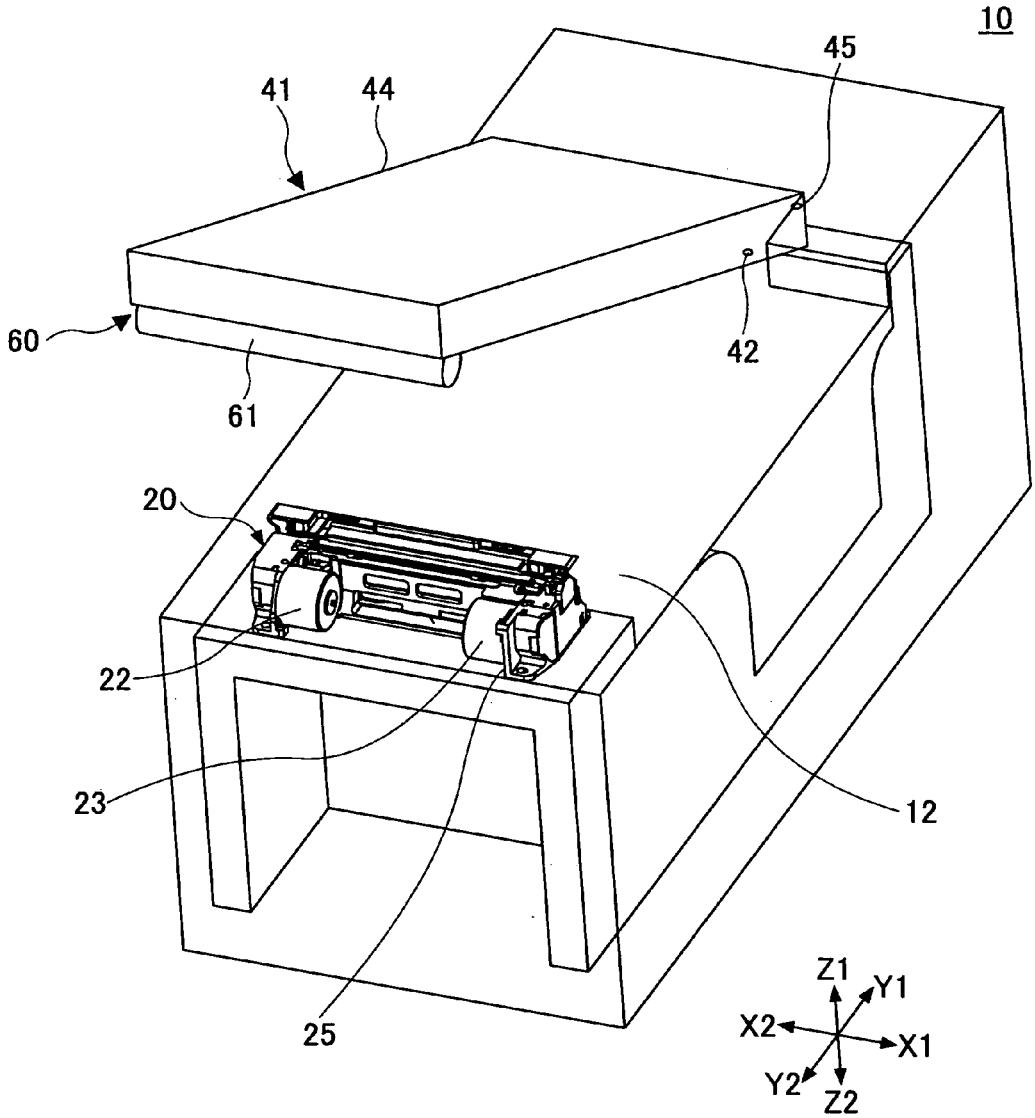
FIG. 6 is a perspective view showing an opened state of a cover of the printer apparatus according to an embodiment of the present invention.

The presenter unit part 41, which is provided on the upper part of the cover 40, includes the outer-cover 43 covering the cover 40 and a paper accommodating space 44 located between the cover 40 and the outer-cover 43 for installing paper (e.g. receipt) therein. The presenter unit part 41 has a discharge space (first opening) 46 provided toward the Y2 direction side and another space (second opening) 47 provided toward the Y1 direction side. As shown in FIG. 6, the presenter unit part 41 can be opened and closed with respect to the apparatus frame 11 by rotationally moving (pivotally moving) around the shaft 45.

Figure 7:
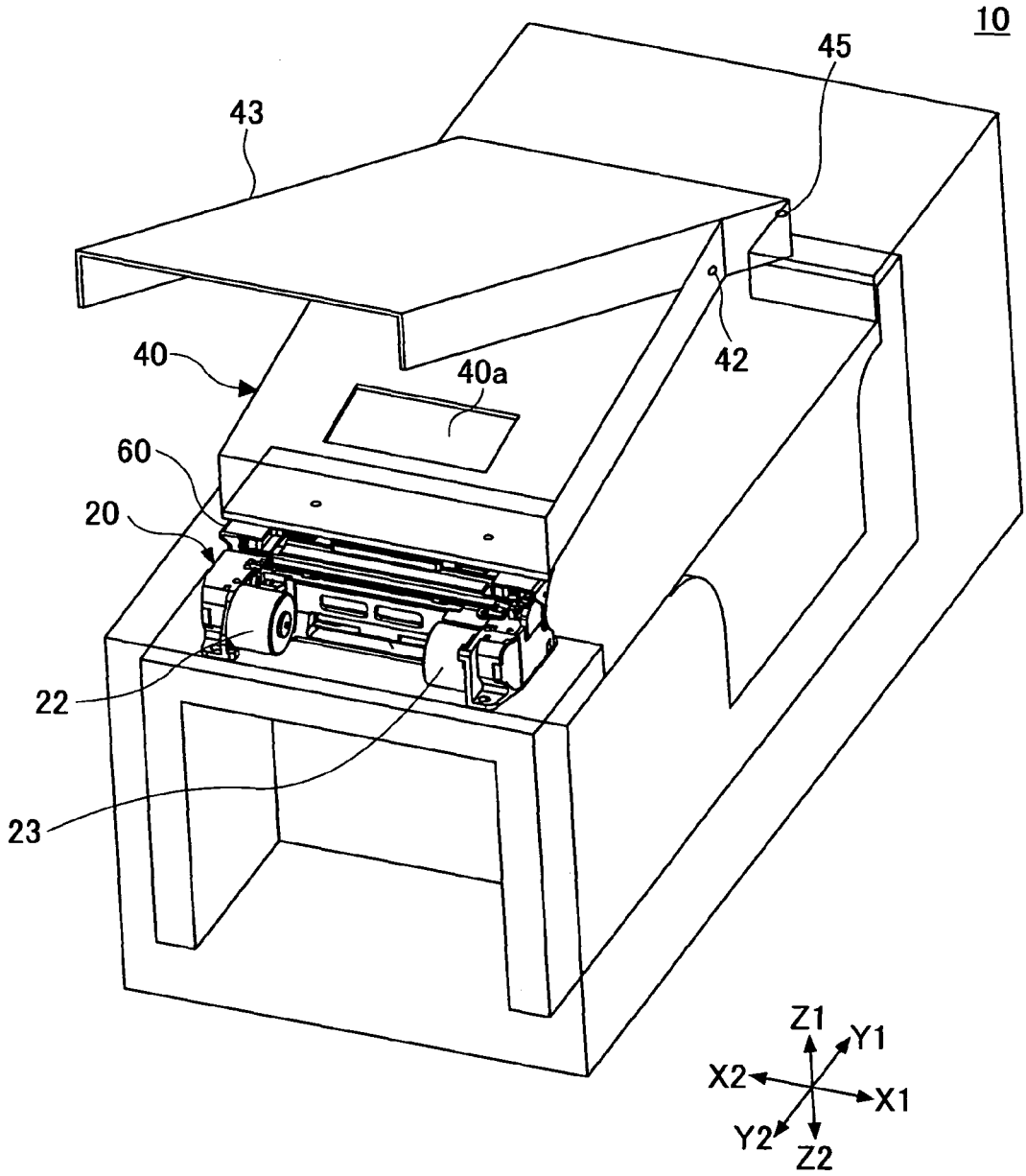
FIG. 7 is a perspective view showing an open state of an outer-cover of the printer apparatus according to an embodiment of the present invention.

As shown in FIG. 7, the outer-cover 43 of the presenter unit part 41 can be independently opened and closed with respect to the cover 40 by rotationally moving around a shaft 42. The outer-cover 43 may be transparent. The cover 40 also includes a paper discharge opening 40*a* (See FIG. 7).

The cover 40 may be integrally formed as a united body with a sub-module frame 65 (described below).

As shown in FIGS. 1 and 4, the sub-module 60 includes the sub-module frame 65 to which components, for example, a platen roller 61, the movable 62, and paper conveying rollers 63X1, 63X2 are attached. The sub-module 60 is attached to a front end part of the cover 40. The paper conveying rollers 63X1, 63X2 abut the lower surface of the outer-cover 43.

Figure 5:
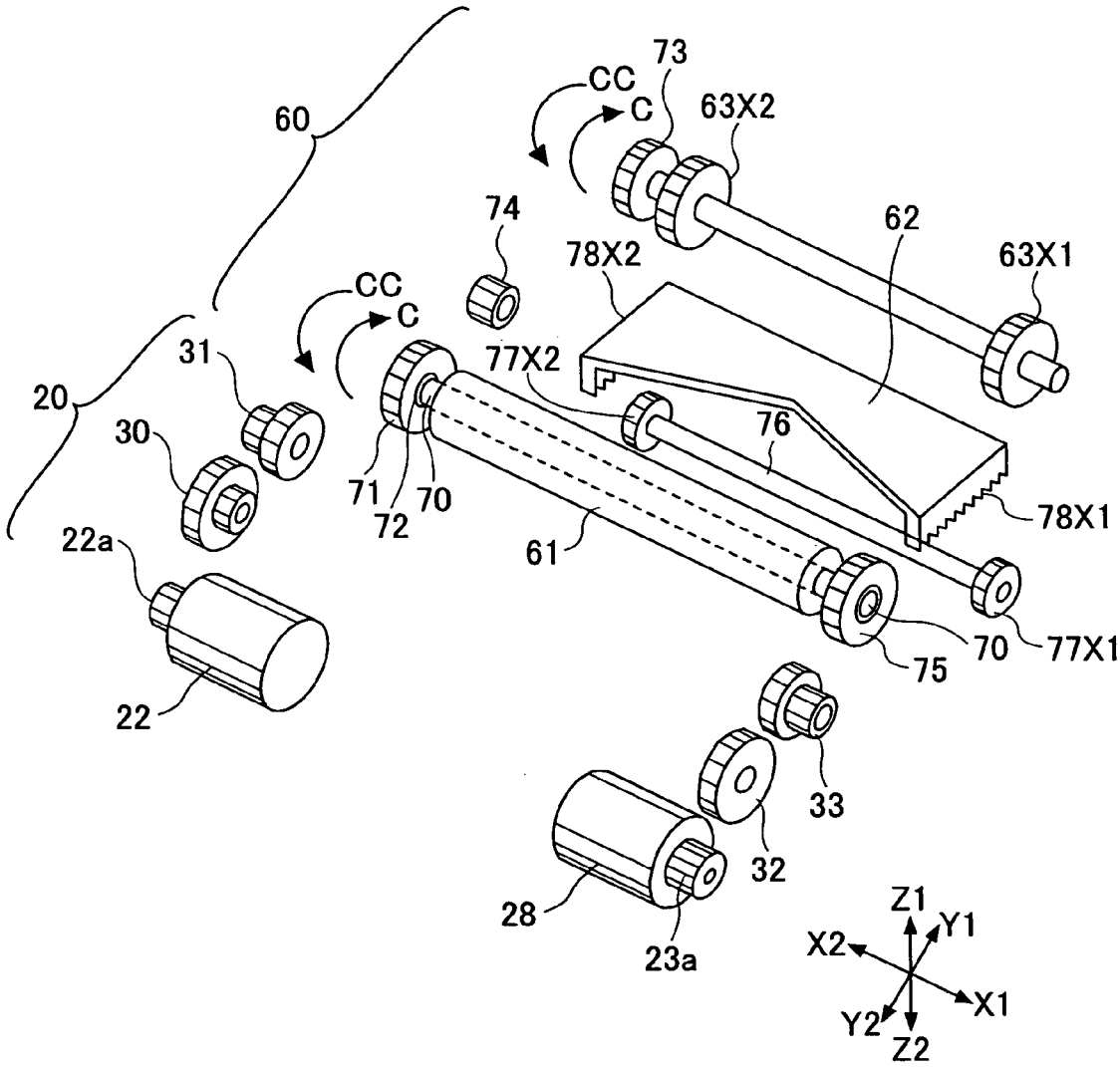
FIG. 5 is a schematic drawing for describing a rotation transmitting mechanism according to an embodiment of the present invention.

As shown in FIG. 5, the main module 20 has gears 30, 31 provided on the X2 side and gears 32, 33 provided on the X1 side. The gear 30 meshes with a gear 22*a* of a spindle of a motor part 22 and the gear 31. The gear 32 meshes with a gear 23*a* of a spindle of another motor part 23 and the gear 33.

With respect to the X2 side, the sub module 60 has a gear 71 provided on a shaft 70 of the platen roller 61. A one-way clutch 72 is provided between the gear 71 and the shaft 70. The one-way clutch 72 transmits the clockwise (direction C in FIG. 5) rotation of the gear 71 to the shaft 70. In a case where the gear 71 rotates in a counter-clockwise direction (direction CC in FIG. 5), the one-way clutch 72 prevents the counter-clockwise rotation of the gear 71 from being transmitted to the shaft 70. A gear 73 is fixed on one end of an axle 63 of the paper conveying rollers 63X1, 63X2. A gear 74 is provided between the gear 71 and the gear 73 for meshing with both gears 71, 73.

With respect to the X1 side, the sub-module 60 has a gear 75 that is freely rotatably attached to the shaft 70 of the platen roller 61.

Furthermore, the sub-module 60 has gears 77X1, 77X2 fixed on corresponding ends of a shaft 76. Moreover, a rack 78X1 is fixed to a lower surface of the movable blade 62 on the X1 side and a rack 78X2 is fixed to a lower surface of the movable blade 62 on the X2 side. The gear 77X1 meshes with the gear 75 and the rack 78X1. The gear 77X2 meshes with the rack 78X2. Accordingly, the gears of the sub-module 60 and the gears of the main module 20 provide a rotation transmitting mechanism for transmitting the rotation of the motor 22 (23) to the movable components of the printer apparatus 10 including, for example, the platen roller 61, the paper conveying rollers 63X1, 63X2, and the movable blade 62.

The paper conveying rollers 63X1, 63X2 may be positioned more toward the Y1 direction than the thermal paper roll 1 in a manner having paper pinched between the paper conveying rollers 63X1, 63X2 and the outer-cover 43.

[Process of Mounting the Thermal Paper Roll 1]

Next, an example of an operation of mounting the thermal paper roll 1 in the printer apparatus 10 is described. In this example, the printer apparatus 20 is mounted inside of a cash register.

First, the operator of the cash register opens the presenter unit part 41 in a manner shown with the dash double dot lines in FIG. 2(A), places the thermal paper roll 1 inside the thermal paper roll installing part 12, draws out the thermal paper 2 from the thermal paper roll 1, and closes the presenter unit part 41. Then, the operator pulls the thermal paper protruding higher than the platen roller and cuts the thermal paper with the fixed blade 24. The cover 40 is locked by engaging the shaft 70 of the platen roller 61 with the locking member 26. By coupling the sub-module 60 to the main module 20, the gear 71 meshes with the gear 31, the gear 75 meshes with the gear 33, the end part of the paper 2 of the thermal paper roll 1 is held (sandwiched) between the platen roller 61 and the thermal head 21, and the movable blade 62 and the fixed blade 24 are positioned in a manner facing each other. Accordingly, the area for printing onto the paper (printing part) is arranged between the platen roller 61 and the thermal head 21, and the area for cutting the paper (cutting part) is located between the movable blade 62 and the fixed blade 24. It is to be noted that the operation of cutting the paper 2 of the thermal paper roll 1 may also be performed by activating the cutter stepping motor 23 and moving the movable blade 62.

As shown in FIG. 1, an end part 40*a* of the cover 40 is situated more toward the Y1 direction compared to the position of the thermal head 21. An end part 43*a* of the outer-cover 43 is situated more toward the Y2 direction compared to a Y2 end part 40*a* of the cover 40 and more toward the Y1 direction compared to the position of the thermal head 21.

[Operation of the Printer Apparatus 10]

In a state where the thermal paper roll 1 is mounted on the printer apparatus 10, a control apparatus (not shown) sends a printing command, a paper cutting command (receipt cutting command), and a paper discharging command (receipt discharging command) in this order to the printer apparatus 10.

With reference to FIG. 2(A), the thermal head 21 is activated and the stepping motor 22 is driven and rotated in a forward direction when the printer apparatus 10 receives the printing order from the control apparatus. The forward rotation of the stepping motor 22 is transmitted to the platen roller 61 via the one-way clutch 72. Accordingly, the platen roller 61 rotates in a clockwise direction (direction C in FIG. 5). The rotation of the platen roller 61 is transmitted to the paper conveying rollers 63X1, 63X2 via the gears 74, 73. Accordingly, the paper conveying rollers 63X1, 63X2 also rotate in a clockwise direction (direction C in FIG. 5). Thereby, data is printed onto the paper 2 of the thermal paper roll 1. As a result, the paper 2 on which the data is printed becomes a receipt 3. The receipt 3 is delivered out from the printing part by the platen roller 61. The receipt 3 is delivered in a manner having the front end of the receipt 3 curled in a clockwise direction and slightly inclined downward in the Y1 direction. Accordingly, the front end of the receipt 3 contacts the lower surface of the outer-cover 43 and is guided in direction Y1 along the lower surface of the outer-cover 43. In other words, the receipt 3 delivered out by the platen roller 61 can be automatically guided into the presenter unit part 41. As the receipt 3 is delivered in the Y1 direction by the platen roller 61, the front end of the receipt 3 becomes sandwiched (nipped) between the paper conveying rollers 63X1, 63X2 and the outer-cover 43. Then, the rotating paper conveying rollers 63X1, 63X2 further conveys the receipt 3 in the Y1 direction. Thereby, the receipt 3 is conveyed inside the paper accommodating space 44 of the presenter unit part 41. In this example, the side of the receipt 3 on which data is printed faces the Z1 direction. In this state, the operator of the cash register can visually recognize whether data is properly printed on the receipt 3 since the outer-cover 43 is transparent.

In a case where the receipt 3 is long, the space 47 provided in the Y1 side of the presenter unit part 41 allows the front end of the receipt 3 to protrude from the space 47. Accordingly, the receipt 3 can be satisfactorily conveyed even in a case of printing out an extensive receipt 3.

After the operation corresponding to the printing command is completed, the control apparatus sends a receipt cutting command to the printing apparatus 10. In response to the receipt cutting command, the stepping motor 23 is driven. The drive of the stepping motor is transmitted to the racks 78X1, 78X2 of the movable blade 62 via the gears 32, 33, 75, 77X1, and 77X2. Accordingly, the racks 78X1, 78X2 are driven and the movable blade 62 is moved in the Y2 direction. Thereby, the end of the receipt 3 is cut as shown in FIG. 2(C). As a result, the receipt 3 becomes a cut-off receipt 4. Then, the movable blade 62 is moved back to its original position toward the Y1 direction.

After the operation corresponding to the receipt cutting command is completed, the control apparatus sends a receipt discharging command to the printing apparatus 10. In response to the receipt discharging command, the stepping motor 22 is driven and is rotated in a reverse direction. The rotation of the stepping motor 22 is transmitted to the paper conveying rollers 63X1, 63X2 via the gears 30, 31, 71, 74, and 73. Accordingly, the paper conveying rollers 63X1, 63X2 rotate in a counterclockwise direction (direction CC in FIG. 5). Meanwhile, the platen roller 61 does not rotate since the one-way clutch 72 does not transmit the counterclockwise rotation. As shown in FIG. 2(D), the counterclockwise rotation of the paper conveying rollers 63X1, 63X2 conveys the cut-off receipt 4 in the Y2 direction. Thereby, the cut-off receipt 4 is discharged out of the receipt accommodating part 44 of the presenter unit part 41 from the discharge space 46. Then, the operator of the cash register obtains cut-off receipt 4 discharged from the present unit part 41.

In the same manner, the front end of the receipt 3 is automatically conveyed into the presenter unit part 41 in a subsequent operation corresponding to a subsequent printing command. Following the operation corresponding to the printing command, the above-described operations corresponding to the receipt cutting command and the receipt discharging command are executed in the same manner.

In a case where jamming of the cut-off receipt 4 occurs inside the receipt accommodating part 44, the operator of the cash register can remove the jammed cut-off receipt 4 by opening the outer-cover 43. Furthermore, the operator can adjust the position of the paper 2 of the thermal paper roller 1 (for example, flatten out the jammed receipt) by opening the cover 40 and inserting, for example, his/her finger or a narrow elongated tool in the paper discharge opening 40*a*.

Figure 2:
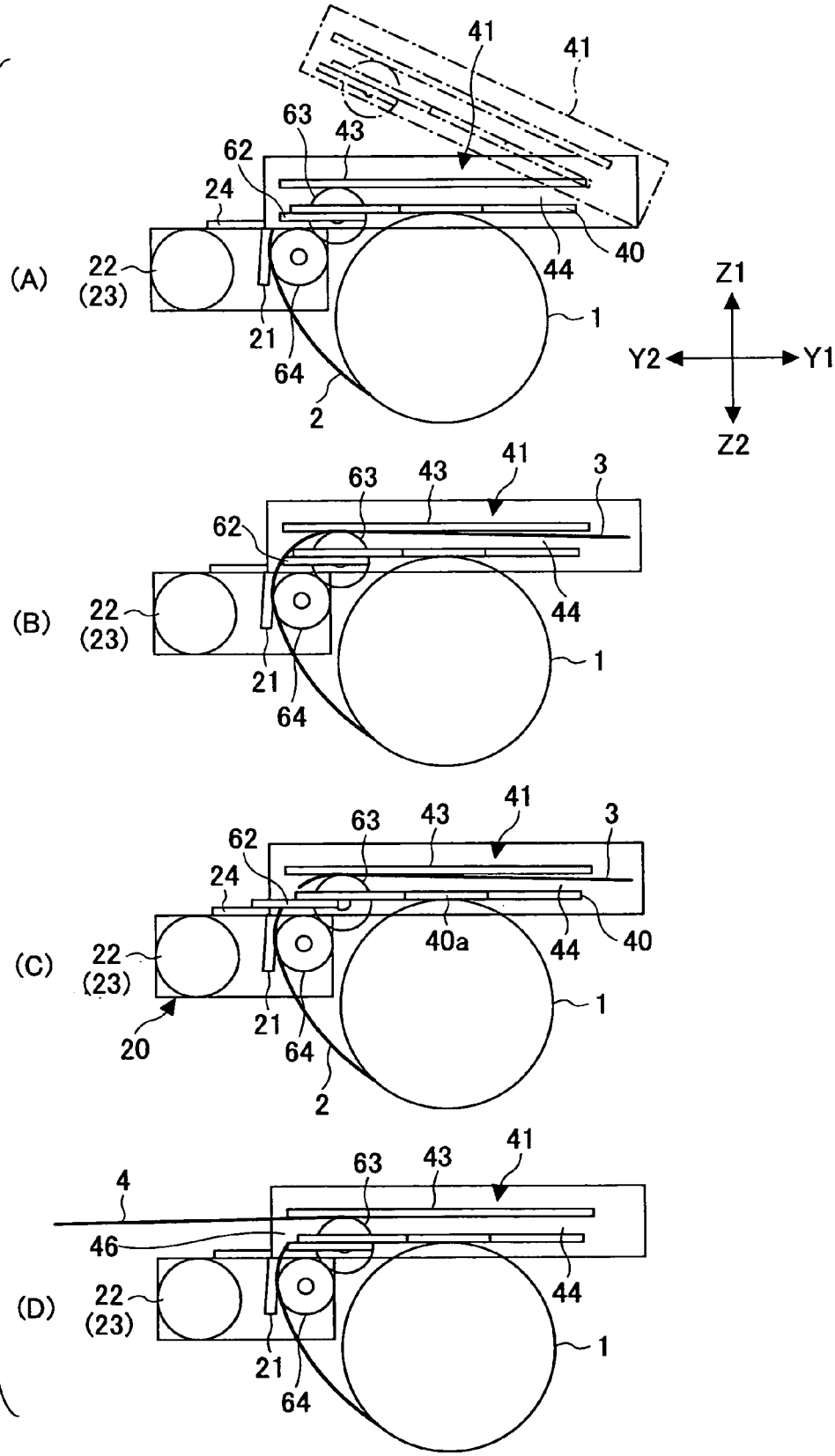
FIG. 2 is a schematic diagram for describing an operation of the printer apparatus shown in FIG. 1.

It is to be noted that FIGS. 1 and 2 show where the printer apparatus 10 is placed on top of a desk, for example.

Although the printer apparatus 10 according to the first embodiment has a configuration in which the cutting part is formed by closing the cover 40, a cutting unit may alternatively be provided at the apparatus frame 11. Furthermore, although the presenter unit part 41 according to the first embodiment is provided above the cover 40, the presenter unit part 41 may alternatively be provided beneath the cover 40.

Second Embodiment

Figure 8A:
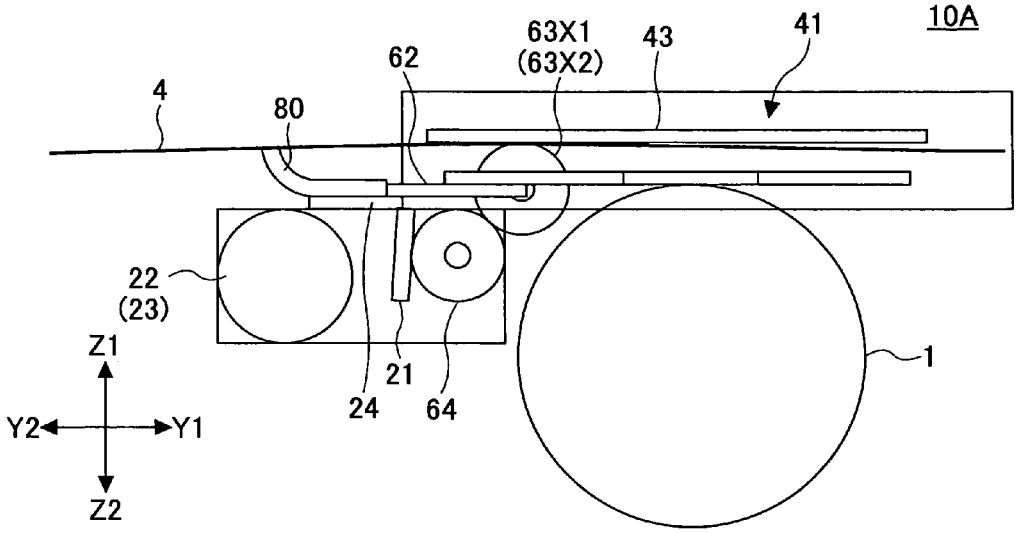
FIG. 8A is a schematic drawing showing a printer apparatus having a presenter function according to a second embodiment of the present invention (in a regular receipt discharging operation)

FIG. 8A is a schematic drawing showing a printer apparatus 10A according to the second embodiment of the present invention. The printer apparatus 10A has substantially the same configuration as the printer apparatus 10 of the first embodiment except that the printer apparatus 10A includes a receipt guiding member (cut-off receipt guiding member) 80. Furthermore, in the printer apparatus 10A, the movable blade 62 is utilized for changing the orientation of the receipt guiding member 80. In the description and drawings of the second embodiment, like components are denoted with like reference numbers as of the first embodiment.

The receipt guiding member 80 is attached to the main module 20. In a case where the cover 40 is closed, the receipt guiding member 80 is substantially horizontal facing the discharge space 64 of the presenter unit part 41. Moreover, in a case where the cover 40 is closed, the receipt guiding member 80 is configured to be pushed in the Y2 direction by the movable blade 62 advancing in the Y2 direction. When the receipt guiding member 80 is pushed in the Y2 direction, a cam mechanism (not shown) causes the receipt guiding member 80 to project upward as shown FIG. 8B.

Furthermore, in a case where the printer apparatus 10A receives a discharge direction changing command between the receipt cutting operation and the receipt discharging operation (i.e. when a discharge direction changing command is sent following the execution of the receipt cutting operation), the stepping motor 23 is further driven and rotated in correspondence with the discharge direction changing command.

In a regular receipt discharging operation (first receipt discharging operation), the receipt guiding member 80 is arranged in a horizontal state, and the cut-off receipt 4 is discharged in the Y2 direction from the discharge space 46.

Figure 8B:
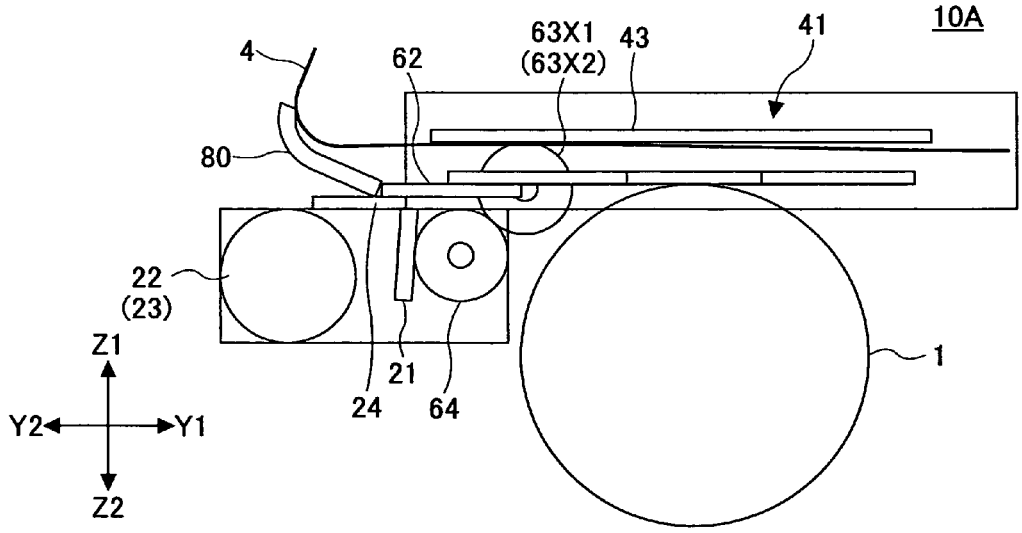
FIG. 8B is another schematic drawing showing a printer apparatus having a presenter function according to the second embodiment of the present invention (in an alternative receipt discharging operation)

In a case where the printer apparatus 10A receives the discharge direction changing command following the execution of the receipt cutting command (second receipt discharging operation), the stepping motor 23 is further driven and rotated in correspondence with the discharge direction changing command. Accordingly, as shown in FIG. 8B, the movable blade 62 is moved more toward the Y2 direction (compared to the regular movement of the movable blade 62). As a result, the movable blade 62 exerts a pressing force on the receipt guiding member 80 in the Y2 direction. Thereby, the receipt guiding member 80 is projected upward as shown in FIG. 8B.

Hence, the projected receipt guiding member 80 allows the discharging direction of the cut-off receipt 4 to change from the Y2 direction to the Z1 direction.

Figure 9:
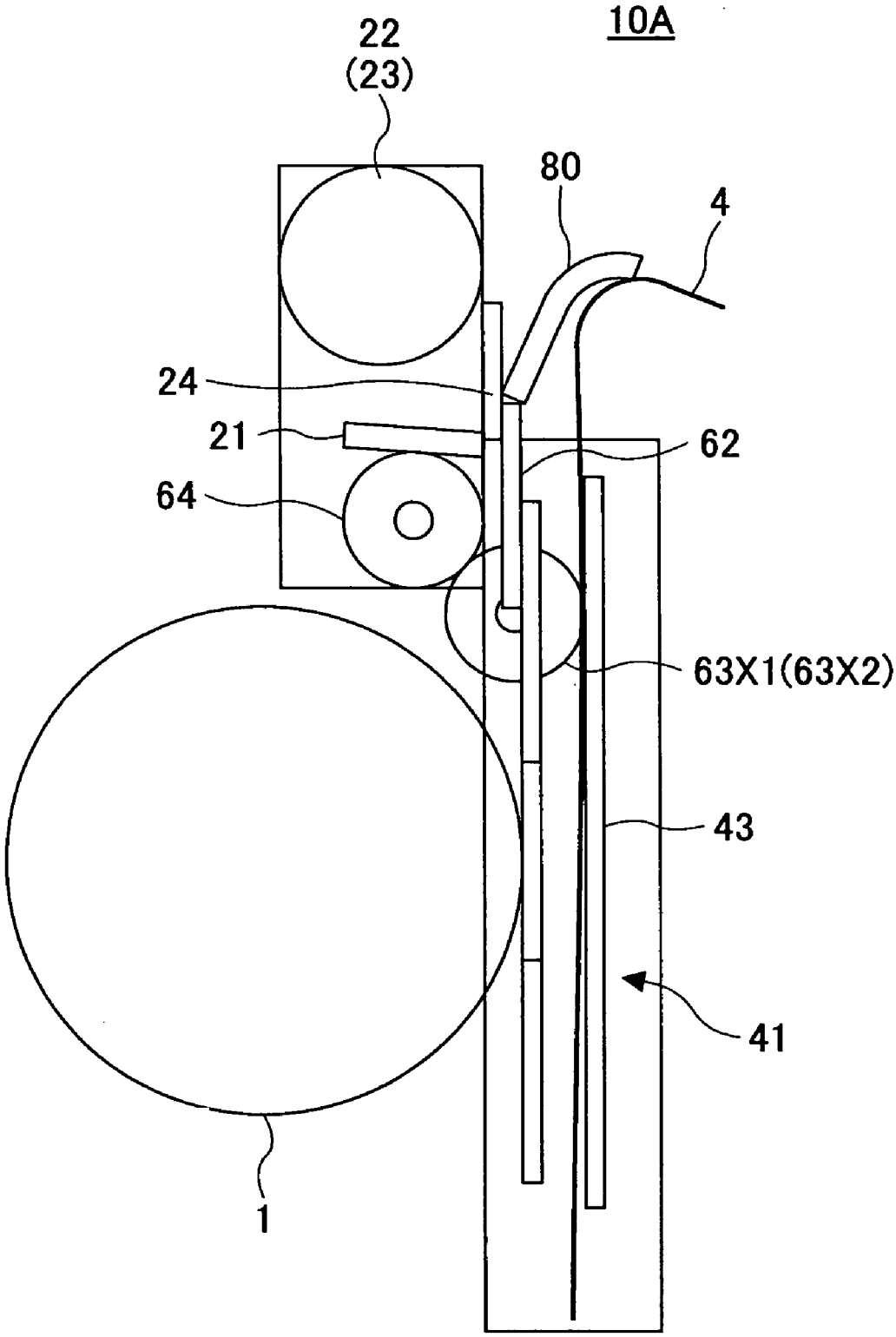

In a case where the printer apparatus 10A is set in an upright position (vertical position) for mounting to, for example, a panel or a wall as shown in FIG. 9, the projected receipt guiding member 80 allows the cut-off receipt 4 to be conveyed to the front side of the cash register. In this case, the backside of the receipt 4 faces toward the operator of the cash register 4. However, where the receipt 3 is disposed inside the presenter unit part 41, the operator can visually recognize the printed data on the receipt 4 by looking through the transparent outer-cover 43.

Third Embodiment

Figure 10A:
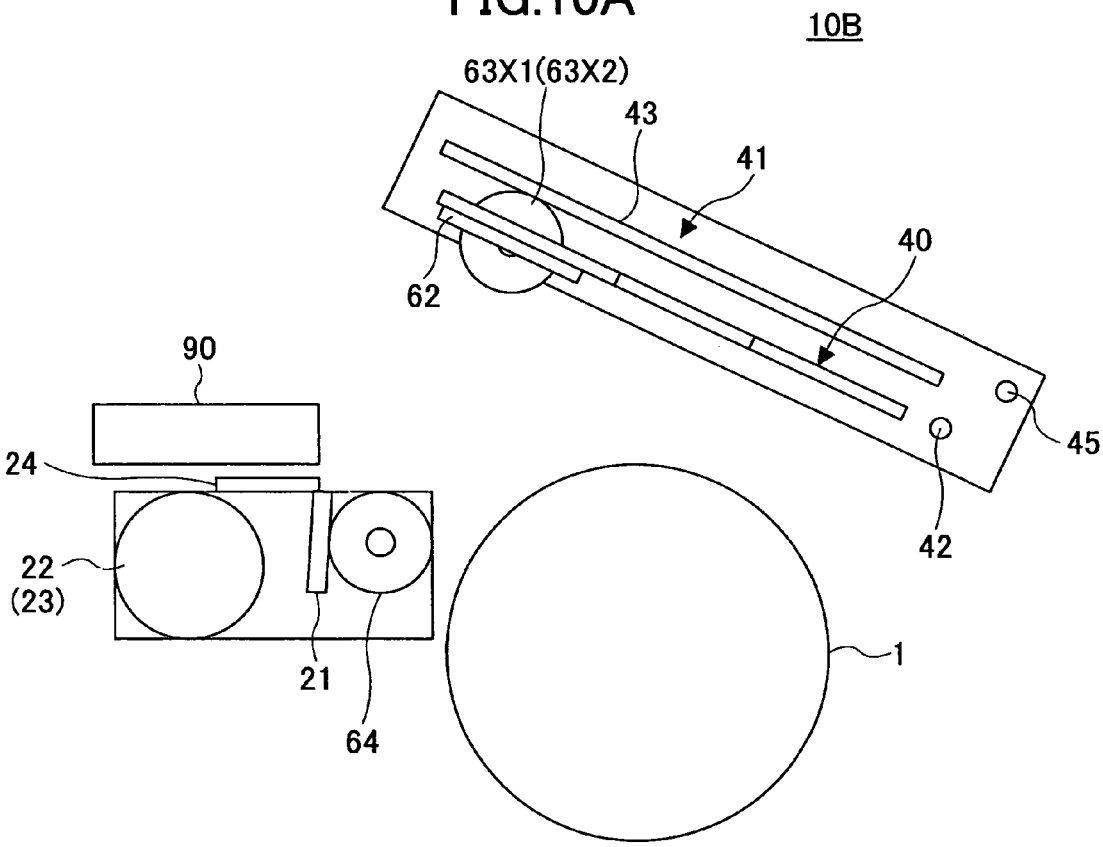
FIG. 10A is a schematic drawing showing a printer apparatus having a presenter function according to a third embodiment of the present invention in a case where a cover is open.
Figure 10B:
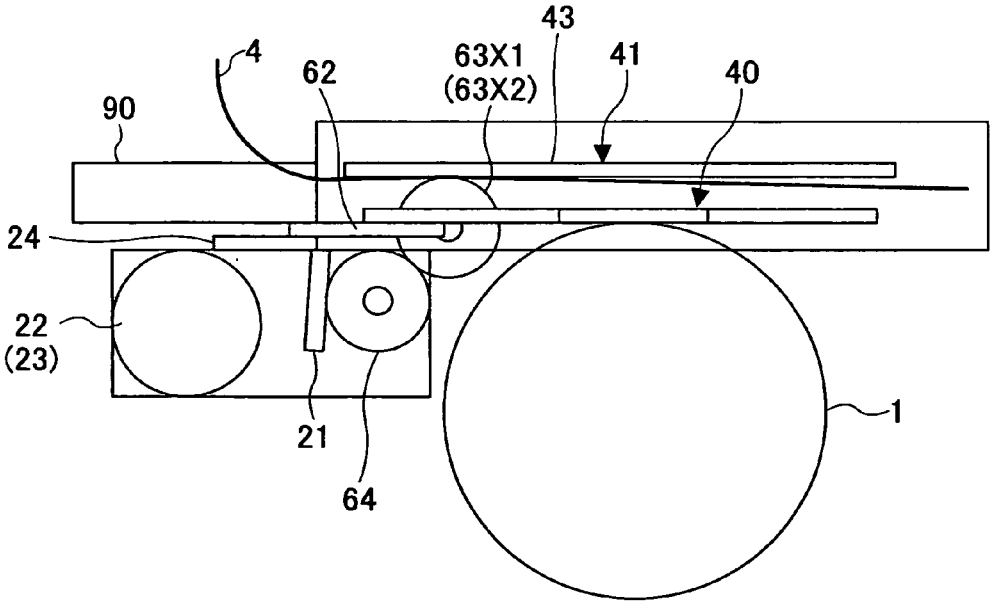
FIG. 10B is another schematic drawing showing a printer apparatus having a presenter function according to the third embodiment of the present invention in a case where a cover is closed.

FIGS. 10A and 10B are schematic drawings showing a printer apparatus 10B according to the third embodiment of the present invention. The printer apparatus 10B has substantially the same configuration as the printer apparatus 10 of the first embodiment except that movable blade 62 can maintain its position after moving in the Y2 direction even during the receipt discharging operation. Furthermore, the printer apparatus 10B also includes a casing (stopper part) 90 for accommodating the movable blade 62 therebelow after being moved in the Y2 direction (See FIG. 10B).

As shown in FIG. 10A, the cover 40 can be freely opened and closed in a case where the movable blade 62 is situated in its original position (See FIG. 10A). However, during the receipt discharging operation, the movable blade 62 is positioned beneath the casing 90 (See FIG. 10B). Accordingly, the cover 40 can be prevented from opening since the casing 90 serves to restrict the movable blade 62 in the vertical direction (Z1-Z2 direction). Therefore, the cover 40 can be maintained closed during the receipt discharging operation.

Accordingly, in a case where the operator of the cash register inadvertently attempts to open the cover 40 during the receipt discharging operation, the cover 40 cannot be opened. Accordingly, the presenter unit part 41 can maintain its regular position.

Further, the present invention is not limited to these embodiments, but variations and modifications may be made without departing from the scope of the present invention.

The present application is based on Japanese Priority Application No. 2005-325121 filed on Nov. 9, 2005, with the Japanese Patent Office, the entire contents of which are hereby incorporated by reference.

What is claimed is:

1. A printer apparatus comprising:

a main body having a paper roll installing part containing a paper roll therein;

a cover covering the paper roll installing part when the cover is closed;

a printing part, including a platen roller, printing data onto a part of the paper roll; and a presenter unit part, including a paper conveying roller, that is pivotally movably mounted on the cover;

wherein the presenter unit part is configured to accommodate the printed portion of the paper roll, cut off the printed portion from the paper roll, and discharge the cut-off printed portion therefrom, and the presenter unit part includes a movable blade movably attached to the presenter unit part;

wherein the presenter unit part has a first opening to receive a top end part of the printed portion, a second opening to selectively receive the top end part of the printed portion, the printed portion moving through the second opening in a first direction, and a third opening through which a bottom end part of the printed portion is conveyed in a second direction opposite to the first direction.

2. The printer apparatus as claimed in claim 1, wherein the presenter unit part includes an outer-cover situated above the cover accommodating the printed portion therein, and the paper conveying roller discharges the cut-off printed portion.

3. The printer apparatus as claimed in claim 2, further including a shaft, wherein the outer-cover is openable with respect to the cover by rotation about the shaft.

4. The printer apparatus as claimed in claim 2, wherein the paper conveying roller abuts a lower surface of the outer-cover.

5. The printer apparatus as claimed in claim 2, wherein the outer-cover is transparent.

6. The printer apparatus as claimed in claim 2, further comprising a rotation transmitting mechanism;

wherein the main body includes a rotating motor, wherein the cover is openable by rotational movement, wherein the printing part includes a thermal head attached to the main body and the platen roller is attached to the cover, wherein the thermal head and the platen roller abut against each other when the cover is closed, wherein the rotation transmitting mechanism is configured to transmit the rotation of the motor to the platen roller and the paper conveying roller.

7. The printer apparatus as claimed in claim 1, wherein the cover includes an opening adjusting the position of the printed portion of the paper roll.

8. The printer apparatus as claimed in claim 1, wherein the platen roller moves the printed portion in the first direction prior to the cut off of the printed portion, and the paper conveying roller moves the printed portion in the second direction opposite to the first direction after the cut off of the printed portion.

9. A printer apparatus comprising:

a main body having a paper roll installing part containing a paper roll therein;

a cover covering the paper roll installing part when the cover is closed;

a printing part, including a platen roller, printing data onto a part of the paper roll;

a cutting part cutting off the printed portion from the paper roll; and a presenter unit part, including a paper conveying roller, that is pivotally movably mounted on the cover;

wherein the presenter unit part is configured to accommodate the cut-off printed portion of the paper roll and discharge the cut-off printed portion therefrom, and the cutting part includes a movable blade movably attached to the cover;

wherein the presenter unit part has a first opening to receive a top end part of the printed portion, a second opening to selectively receive the top end part of the printed portion, the printed portion moving through the second opening in a first direction, and a third opening through which a bottom end part of the printed portion is conveyed in a second direction opposite to the first direction.

10. The printer apparatus as claimed in claim 9, wherein the presenter unit part includes an outer-cover situated above the cover accommodating the cut-off printed portion therein, and the paper conveying roller discharges the cut-off printed portion.

11. The printer apparatus as claimed in claim 10, wherein the outer-cover is openable with respect to the cover.

12. The printer apparatus as claimed in claim 10, wherein the paper conveying roller abuts a lower surface of the outer-cover.

13. The printer apparatus as claimed in claim 10, wherein the outer-cover is transparent.

14. The printer apparatus as claimed in claim 10, further comprising a rotation transmitting mechanism;

wherein the main body includes a rotating motor, wherein the cover is openable by rotational movement, wherein the printing part includes a thermal head attached to the main body and the platen roller is attached to the cover, wherein the cutting part includes a fixed blade fixed to the main body and a movable blade movably attached to the cover, wherein the thermal head and the platen roller abut against each other when the cover is closed, wherein the rotation transmitting mechanism is configured to transmit the rotation of the motor to the platen roller, the paper conveying roller, and the movable blade.

15. The printer apparatus as claimed in claim 14, further comprising:

a guiding member guiding the cut-off printed portion discharged from the presenter unit part;

wherein the movable blade exerts force on the guiding member changing the discharging direction of the cut-off printed portion.

16. The printer apparatus as claimed in claim 14, further comprising:

a stopper part preventing the cover from opening by limiting the movement of the movable blade after the movable blade is moved to a position cutting the printed portion.

17. The printer apparatus as claimed in claim 14, wherein the rotation transmitting mechanism is a clutch to selectively transmit the rotation of the motor to the platen roller and the paper discharging roller, such that the platen roller is not rotated and the paper discharging roller is rotated after the cut off of the printed portion so that the paper conveying roller moves the printed portion in the second direction.

18. The printer apparatus as claimed in claim 9, wherein the cover includes an opening adjusting the position of the printed portion of the paper roll.

19. The printer apparatus as claimed in claim 9, wherein the platen roller moves the printed portion in the first direction prior to the cut off of the printed portion, and the paper conveying roller moves the printed portion in the second direction opposite to the first direction after the cut off of the printed portion.

* * * * *